US007451061B2

(12) United States Patent
Saunders

(10) Patent No.: US 7,451,061 B2
(45) **Date of Patent: *Nov. 11, 2008**

(54) COMPRESSOR PERFORMANCE CALCULATOR

(75) Inventor: Michael A Saunders, Sidney, OH (US)

(73) Assignee: Copeland Corporation LLC, Sidney, OH (US)

( * ) Notice: Subject to any disclaimer, the term of this patent is extended or adjusted under 35 U.S.C. 154(b) by 184 days.

This patent is subject to a terminal disclaimer.

(21) Appl. No.: 11/043,805

(22) Filed: Jan. 26, 2005

(65) Prior Publication Data

US 2005/0131654 A1 Jun. 16, 2005

Related U.S. Application Data

(63) Continuation of application No. 10/265,220, filed on Oct. 4, 2002, now Pat. No. 6,928,389.

(51) Int. Cl.
*F04B 51/00* (2006.01)

(52) U.S. Cl. ..... 702/182; 702/183; 62/298; 62/467

(58) Field of Classification Search ..... 702/182–183; 62/192, 126, 208–209, 149, 172–174, 230, 62/467, 190, 298
See application file for complete search history.

(56) References Cited

U.S. PATENT DOCUMENTS 3,350,928 A 11/1967 Fedde
5,748,943 A 5/1998 Kaepp et al.
5,860,285 A 1/1999 Tulpule
6,209,794 B1 4/2001 Webster et al.
6,272,868 B1 8/2001 Grabon et al.
6,330,525 B1 12/2001 Hays et al.
6,477,518 B1 11/2002 Li et al.
6,487,525 B1 11/2002 Hall et al.
6,505,475 B1 1/2003 Zugibe et al.
6,591,620 B2 7/2003 Kikuchi et al.
6,651,037 B1 11/2003 Hall et al.

(Continued)

FOREIGN PATENT DOCUMENTS

EP 1 211 617 A 6/2002

(Continued)

OTHER PUBLICATIONS

European Search Report for Application No. EP 03 25 2757, dated Mar. 11, 2004; 2 Pages.

(Continued)

*Primary Examiner*—John E. Barlow
*Assistant Examiner*—Hien X Vo
(74) *Attorney, Agent, or Firm*—Harness, Dickey & Pierce, P.L.C.

(57) ABSTRACT

A system and method for calculating the performance of a compressor includes a controller in communication with a cooling system. A database includes compressor specification data. A computer communicates with the controller and accesses the database. A user interface associated with the computer is operable to select a compressor from the database, input application conditions, compare data for the selected compressor to the inputted application conditions, and verify operating limits of the selected compressor based on the compressor specification data and the input application conditions.

37 Claims, 8 Drawing Sheets

U.S. PATENT DOCUMENTS

| | | | | |
|---|---|---|---|---|
| 6,675,591 | B2 | 1/2004 | Singh et al. | |
| 6,684,178 | B2 | 1/2004 | DeRose et al. | |
| 6,698,663 | B2 | 3/2004 | Wang et al. | |
| 6,775,995 | B1 | 8/2004 | Bahel et al. | |
| 6,968,295 | B1 * | 11/2005 | Carr | 702/188 |
| 2002/0161776 | A1 * | 10/2002 | Lanfredi et al. | 707/101 |
| 2002/0189267 | A1 | 12/2002 | Singh et al. | |
| 2003/0208341 | A9 | 11/2003 | Simmons et al. | |
| 2004/0016253 | A1 | 1/2004 | Street et al. | |

FOREIGN PATENT DOCUMENTS

| | | |
|---|---|---|
| EP | 1 229 479 A | 8/2002 |
| EP | 1 406 014 A2 | 4/2004 |
| JP | H9-257319 | 10/1997 |
| WO | WO 99/17178 | 4/1999 |

OTHER PUBLICATIONS

Emma May Sadler, Design Analysis of a Finned-Tube Condenser for a Residential Air-Conditioner Using R-22, Apr. 2000, 147 pages.
Response to Notice of Opposition to European Patent Application No. 03252757.4, dated May 24, 2007.
Letter from Ulrike Sieger-Koser to Herr Ridder dated Apr. 2, 2002.
Fax from Sabine Dorsam to Hotel Steigenberger dated Apr. 12, 2002.
Notice of Opposition to European Patent Application No. 03252757.4, dated Sep. 26, 2006.

* cited by examiner

Evaporating Temperature F (Sat Dew Pt Pressure, psia)

Cell A

| Condensing Temperature F (Sat Dew Pt Pressure, psia) | | -10(57) | 0(57) | 10(57) | 20(57) | 30(57) | 40(84) | 45(92) | 50(100) | 55(109) |
|---|---|---|---|---|---|---|---|---|---|---|
| 150 (280) | Capacity | | | | | | 37800 | 42300 | 47000 | 52000 |
| | Power | | | | | | 6850 | 6850 | 6800 | 6750 |
| | Amps | | | | | | 19.1 | 19.0 | 19.0 | 18.9 |
| | Mass Flow | | | | | | 730 | 820 | 920 | 1030 |
| | EER | | | | | | 5.5 | 6.2 | 6.9 | 7.7 |
| | % | | | | | | 59.2 | 62.1 | 64.6 | 66.9 |
| 140 (280) | Capacity | | | | | 33800 | 42500 | 47300 | 52500 | 58000 |
| | Power | | | | | 6100 | 6050 | 6000 | 6000 | 5950 |
| | Amps | | | | | 17.2 | 17.1 | 17.0 | 17.0 | 16.9 |
| | Mass Flow | | | | | 580 | 745 | 835 | 935 | 1040 |
| | EER | | | | | 5.6 | 7.0 | 7.9 | 8.8 | 9.7 |
| | % | | | | | 57.2 | 63.2 | 65.8 | 68 | 69.8 |
| 130 (280) | Capacity | | | | 29500 | 37600 | 47000 | 52000 | 58000 | 63500 |
| | Power | | | | 5350 | 5350 | 5300 | 5300 | 5250 | 5250 |
| | Amps | | | | 15.6 | 15.4 | 15.3 | 15.3 | 15.2 | 15.2 |
| | Mass Flow | | | | 463 | 595 | 755 | 845 | 945 | 1060 |
| | EER | | | | 5.5 | 7.1 | 8.9 | 9.9 | 11.0 | 12.2 |
| | % | | | | 55 | 61.6 | 67 | 69.1 | 70.8 | 72 |
| 120 (280) | Capacity | | | 25100 | 32600 | 41300 | 51500 | 57000 | 63000 | 69500 |
| | Power | | | 4730 | 4700 | 4670 | 4640 | 4630 | 4620 | 4610 |
| | Amps | | | 14.0 | 14.0 | 13.9 | 13.8 | 13.8 | 13.7 | 13.7 |
| | Mass Flow | | | 365 | 477 | 610 | 770 | 860 | 960 | 1070 |
| | EER | | | 5.3 | 6.9 | 8.8 | 11.0 | 12.3 | 13.6 | 15.0 |
| | % | | | 52.5 | 59.7 | 65.6 | 70 | 71.5 | 72.5 | 73 |
| 110 (280) | Capacity | | 20900 | 27800 | 35600 | 44700 | 55500 | 61500 | 68000 | 75000 |
| | Power | | 4140 | 4140 | 4120 | 4090 | 4070 | 4060 | 4050 | 4040 |
| | Amps | | 12.7 | 12.7 | 12.6 | 12.5 | 12.5 | 12.5 | 12.4 | 12.4 |
| | Mass Flow | | 284 | 378 | 489 | 620 | 780 | 870 | 970 | 1080 |
| | EER | | 5.0 | 6.7 | 8.6 | 10.9 | 13.6 | 15.1 | 16.8 | 18.5 |
| | % | | 49.6 | 57.4 | 63.8 | 68.7 | 71.9 | 72.7 | 72.8 | 72.2 |
| 100 (280) | Capacity | 16900 | 23100 | 30100 | 38400 | 48000 | 59500 | 65500 | 72500 | 80000 |
| | Power | 3610 | 3620 | 3620 | 3600 | 3590 | 3560 | 3550 | 3550 | 3540 |
| | Amps | 11.5 | 11.5 | 11.5 | 11.4 | 11.4 | 11.3 | 11.3 | 11.3 | 11.3 |
| | Mass Flow | 217 | 296 | 389 | 498 | 630 | 790 | 880 | 980 | 1090 |
| | EER | 4.7 | 6.4 | 8.3 | 10.6 | 13.4 | 16.7 | 18.5 | 20.5 | 22.6 |
| | % | 46.3 | 54.6 | 61.5 | 67 | 70.7 | 72.3 | 72.1 | 71 | 69.2 |
| 90 (280) | Capacity | 18800 | 25000 | 32300 | 40900 | 51000 | 63000 | 70000 | 77500 | 85500 |
| | Power | 3170 | 3170 | 3170 | 3150 | 3130 | 3110 | 3110 | 3100 | 3100 |
| | Amps | 10.5 | 10.5 | 10.5 | 10.5 | 10.4 | 10.4 | 10.4 | 10.4 | 10.4 |
| | Mass Flow | 227 | 305 | 396 | 505 | 635 | 795 | 885 | 990 | 1100 |
| | EER | 5.9 | 7.9 | 10.2 | 13.0 | 16.3 | 20.3 | 22.5 | 24.9 | 27.6 |
| | % | 51.1 | 58.5 | 64.5 | 68.8 | 71 | 70.5 | 69.1 | 66.6 | 63.1 |
| 80 (280) | Capacity | 20200 | 26500 | 34200 | 43200 | 54000 | 67000 | 74000 | 82000 | 90500 |
| | Power | 2780 | 2790 | 2790 | 2790 | 2740 | 2720 | 2710 | 2710 | 2700 |
| | Amps | 9.7 | 9.8 | 9.8 | 9.7 | 9.7 | 9.6 | 9.6 | 9.6 | 9.6 |
| | Mass Flow | 234 | 310 | 400 | 510 | 640 | 800 | 895 | 995 | 1100 |
| | EER | 7.3 | 9.5 | 12.3 | 15.7 | 19.7 | 24.6 | 27.3 | 30.3 | 33.5 |
| | % | 54.5 | 61.1 | 65.9 | 68.8 | 69.2 | 66.1 | 62.9 | 58.6 | 52.9 |

Figure - 7

COMPRESSOR PERFORMANCE CALCULATOR

CROSS-REFERENCE TO RELATED APPLICATIONS

This application is a continuation of U.S. patent application Ser. No. 10/265,220 filed on Oct. 4, 2002 now U.S. Pat. No. 6,928,389. The disclosure of the above application is incorporated herein by reference.

FIELD OF THE INVENTION

The present invention relates to compressor performance and, in particular, to calculating performance parameters for new and existing compressors.

DISCUSSION OF THE INVENTION

Whether troubleshooting or replacing a compressor in an existing system or selecting a compressor for a new system, it is desirable to know how the compressor performs. The performance of a compressor can be captured generally by four operating parameters: Capacity (Btu/hr), Power (Watts), Current (Amps) and Mass Flow (lbs/hr). The following equation can be used to describe each of the above-listed parameters in relation to the others: $\text{Result}=C_0+C_1*T_E+C_2*T_c+C_3*T_E^2+C_4*T_E*T_C+C_5*T_C^2+C_6*T_E^3+C_7*T_C*T_E^2+C_8*T_E*T_C^2+C_8*T_E*T_C^2+C_9*T_C^3$, where $T_E$=Evaporating Temperature (F), $T_C$=Condensing Temperature (F) and $C_0$-$C_9$ are the rating coefficients for each parameter. For this equation, there exists unique rating coefficients for each compressor and for each parameter.

Traditionally, compressor performance data is obtained through reference to large binders of hardcopy performance data, or by using a modeling system, which requires the use of compressor rating coefficients. The difficulty with both of these methods is that the compressors are rated at standard conditions, which means that the sub-cool temperature and either the return gas or the super-heat temperatures remain constant. Neither the hardcopy performance data nor the data derived from the rating coefficients in the modeling system will reliably indicate a suitable compressor when actual conditions are not standard. To modify the standard conditions the sub-cool temperature the return gas or the super-heat temperatures must be manually converted to reflect actual conditions. This conversion requires the understanding of thermodynamic properties as well as knowledge of refrigerant property tables.

In addition, because there are thousands of compressors commercially available, the maintenance of hardcopy binders and modeling systems for each of the compressors is an insurmountable task given rapid industry and product changes. Further, compressor rating coefficients are often re-rated, compounding the difficulty in maintaining accurate data.

The present invention provides a method for determining the performance of a compressor using an updateable performance calculator with a convenient user interface. The performance calculator allows the user to select a compressor either by using a model number or by entering specific design conditions. Additionally, the performance calculator includes a lockout feature that assures the calculator is using the latest and most up-to-date data and methods.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 7 is a data table representing the data points of an operating envelope according to the present invention.

DETAILED DESCRIPTION OF THE PREFERRED EMBODIMENTS

The following description of the preferred embodiment(s) is merely exemplary in nature and is in no way intended to limit the invention, its application or uses.

Figure 1:
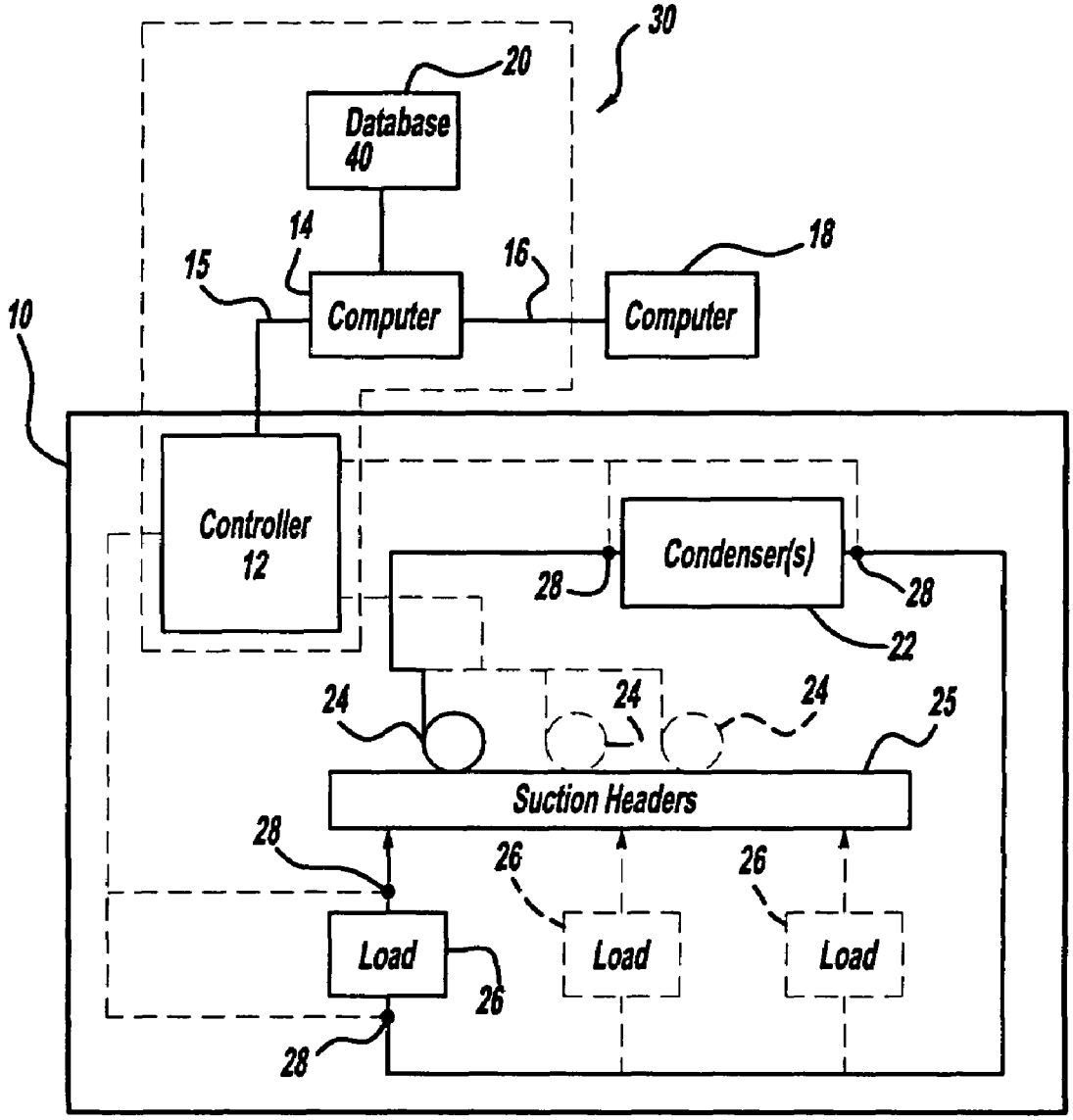
FIG. 1 is an illustration of a cooling system implementing the performance calculator of the present invention.

FIG. 1 illustrates a cooling system 10 incorporating a performance calculator 30 of the present invention. Cooling system 10 includes controller 12 that communicates with computer 14 through communication platform 15. Communication platform 15 may be Ethernet, ControlNet, Echelon or any other comparable communication platform. As shown, internet connection 16 provides a connection to another computer 18. In addition to linking system components of cooling system 10, internet connection 16 also provides access to the Internet through computer 14. Internet connection 16 allows the user to remotely access and download performance calculator updates and store database information to memory device 20.

Performance calculator 30 is shown schematically as including controller 12, computer 14, and memory device 20, but more or fewer computers, controllers, and memory devices may be included. For example, controller 12 of cooling system 10 may be a processor or other computing system having the ability to communicate through communication platform 15 or internet connection 16 to computer 18, which is shown external to cooling system 10 and typically at a remote location. Computer 14 is shown located locally, i.e., proximate controller 12 and cooling system 10, but may be located remotely, such as off-premises. Alternatively, computer 14 and computer 18 can be servers, either individually or as a single unit. Further, computer 14 can replace controller 12, and communicate directly with system 10 components and computer 18, or vice versa. Also, memory device 20 may be part of computer 14.

Internal to cooling system 10, condenser 22 connects to compressor 24 and a load 26. Compressor 24, through suction header 25 communicates with load 26, which can be an evaporator, heat exchanger, etc. Through one or more sensors 28, controller 12 monitors system conditions to provide data used by performance calculator 30. The data gathered by sensors 28 can include the current, voltage, temperature, dew point, humidity, light, occupancy, valve condition, system mode, defrost status, suction pressure and discharge pressure of cooling system 10, and additionally can be configured to monitor other compressor performance indicators.

As one skilled in the art can appreciate, there are numerous possibilities for configuring cooling system 10. Although the above-described system is a cooling system, the performance calculator 30 is suitable for other systems including, but not limited to, heating, air conditioning, and refrigeration systems.

Figure 2:
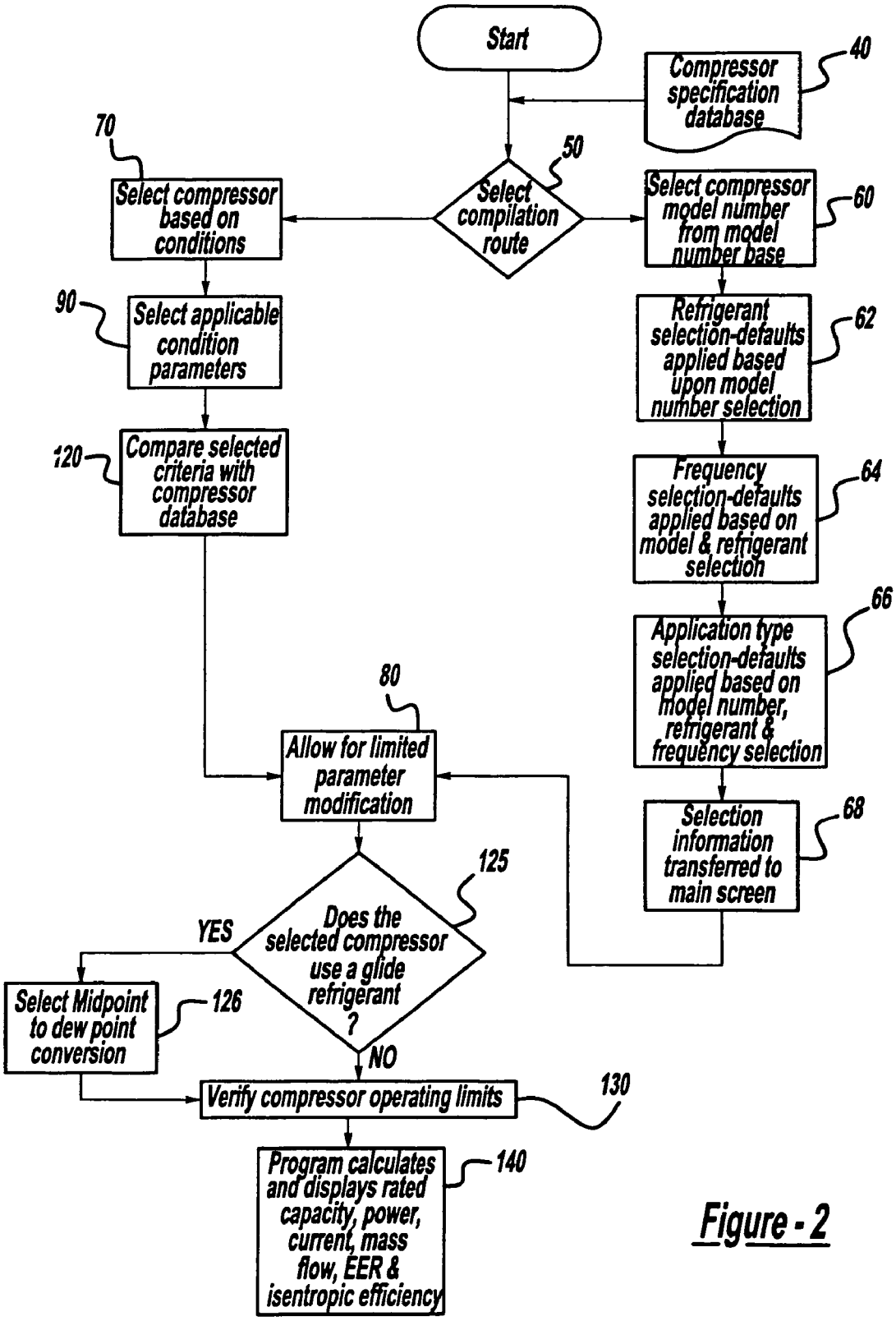
FIG. 2 is a process flow chart illustrating the performance calculation method of the present invention.

Referring to FIG. 2, the compressor performance calculator 30 accesses a compressor specification database 40 containing numerous makes, models, and types of compressors including the performance characteristics for each compressor. Database 40 may be located in memory device 20 or may be otherwise available to performance calculator 30. The stored characteristics may include, but are not limited to, compressor-specific rating coefficients and application parameter limitations.

As previously mentioned, the rating coefficients are calculated at standard conditions and are often re-rated after the compressor is commercially released for sale. In addition, as compressors are continually developed, their rating coefficients and application parameter limitations need to be added to database 40. To assure database 40 includes the most up-to-date data, the performance calculator 30 includes a lockout feature that disables operation after a predetermined period, usually ninety days, until the database is updated. Optionally, updates to the performance calculator 30 can be made by retrieving data via the internet or from any other accessible recording medium.

To begin the calculation process, the user selects a compilation route at step 50. Two examples of compilation routes are selecting a compressor by model number via step 60 or entering design conditions via step 70. Entering design conditions will return a list of compressors suitable for a particular application. Both of the example compilation routes are discussed in detail below.

Figure 3:
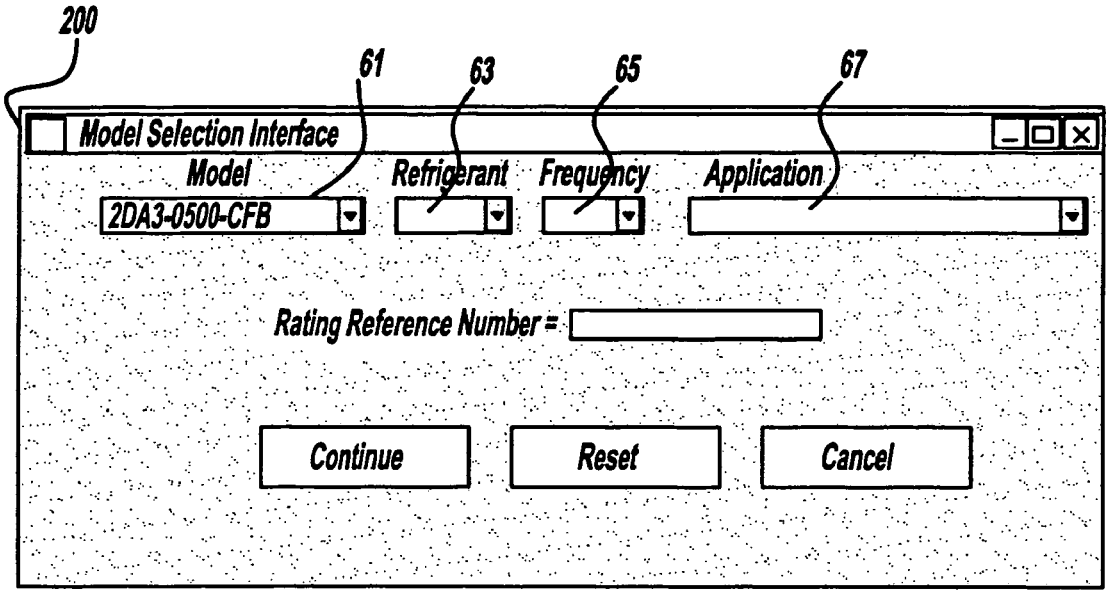
FIG. 3 shows a model selection interface of the present invention.

Continuing the calculation process in FIG. 2, the user selects a model number at step 60. A model selection interface 200 for selecting a compressor by model number is illustrated in FIG. 3. As shown, pull down menus 61, 63, 65, and 67 are used for selecting the model number, refrigerant, frequency, and/or application type, respectively. Once the user selects a model number at step 60, the next available parameter automatically highlights indicating the parameter to be selected next. For example, at step 62, the user might select a refrigerant type from pull down menu 63. This process guides the user through the compilation route because not all parameter combinations are available for each compressor. Depending on the model number selected, there may or may not be steps for selecting refrigerant 62, frequency 64, or application type 66 from pull down menus 63, 65, or 67, respectively. If a choice is limited, the pull-down menus for refrigerant 63, frequency 65, or application type 67 are disabled to prevent changes that differ from the default selection of that parameter.

Figure 4:
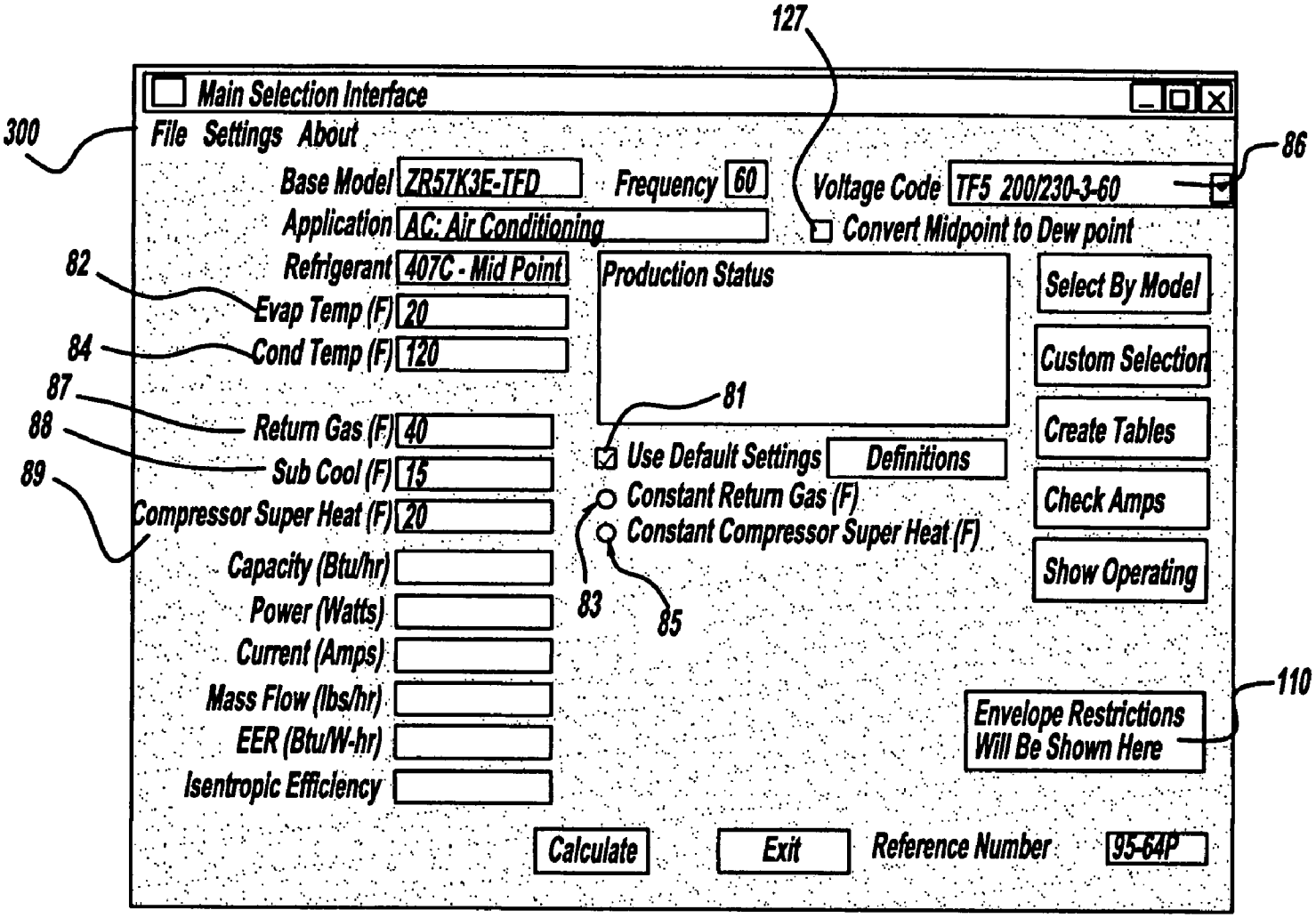
FIG. 4 shows a main selection interface of the present invention.

Returning now to FIG. 2, the remaining available parameters for refrigerant, frequency, and application type are selected at steps 62, 64, and 66, respectively, and then stored for step 68 of the performance calculation process. At main selection interface 300, as shown in FIG. 4, the user may change certain parameters such as the evaporating temperature, the condensing temperature and the voltage via data entry points 82, 84, and 86, respectively, as indicated at step 80 of FIG. 2. The main selection interface 300 is further discussed below.

Figure 5:
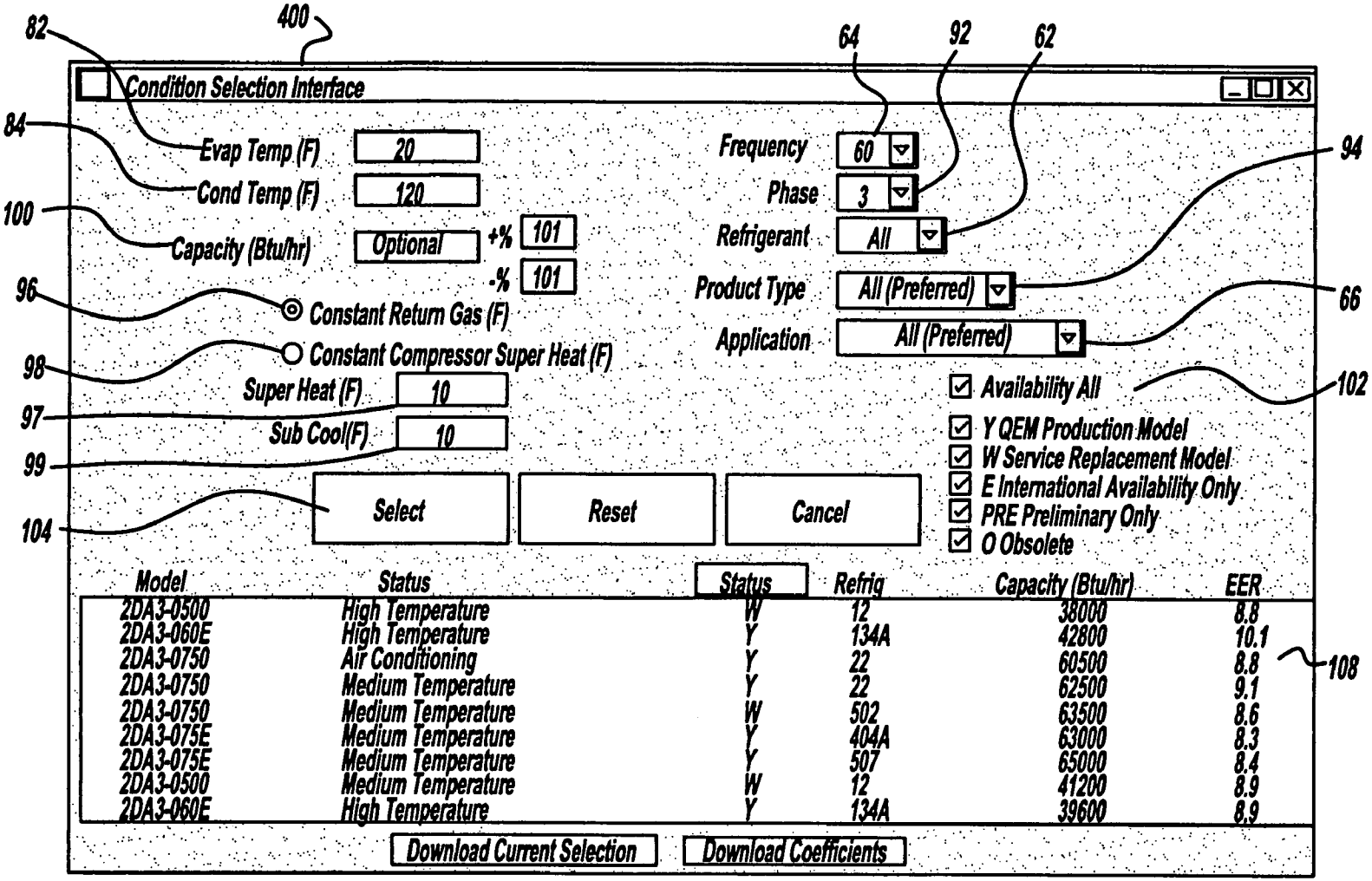
FIG. 5 shows a condition selection interface of the present invention.

Referring again to the beginning of the process in FIG. 2, the user can alternatively select a compilation route based on application conditions at step 70, as illustrated by the condition selection interface 400 of FIG. 5. The application conditions available through the condition selection interface 400 differ than those available via the model selection interface 200 of FIG. 3. Here the user can input values for evaporating temperature and condensing temperature through data entry points 82 and 84, respectively. In addition, parameter selections can be made from pull down menus 64, 92, 62, 94, and 66 for frequency, phase, refrigerant, product type (for example; scroll, discus, hermetic, semi-hermetic and screw) and application type (for example; air conditioning, low temperature, medium temperature or high temperature), respectively. The user may also elect to toggle between selection point 96 for a constant return gas or selection point 98 for constant compressor super-heat temperature. When a constant return gas is selected at selection point 96, the user is able to input values for return gas temperature and sub-cool temperature at data entry points 97 and 99, respectively. Conversely, when a constant super-heat temperature is selected at selection point 98, the user inputs values for the super-heat and the sub-cool temperatures at data entry points 97 and 99, respectively. The nomenclature for data entry point 97 changes depending on whether there is a constant return gas or a constant superheat. For example, when a constant return gas is selected, the nomenclature for data entry point 97 reads "return gas." However, if a constant super-heat is selected, the nomenclature reads "super-heat."

In addition, at data entry points 100 and 101, the user may select a capacity rate and a capacity tolerance percentage, respectively. Compressor capacity is expressed in terms of its enthalpy, which is a function of a compressor's internal energy plus the product of its volume and pressure. More specifically, the change in compressor enthalpy multiplied by its mass flow defines its capacity. The tolerance percentage refers to its capacity in Btu/hr.

Lastly, at selection point 102, the user may elect to narrow the selection list of compressors by selecting a compressor by category. For example, the user may only be interested in compressors that are OEM production, service replacement or internationally available models.

When all selections are complete, the user activates the select button 104, which initiates at step 120 a query of database 40 for records that match the design criteria. As discussed previously, each compressor's rating coefficients are representative of the compressor when measured at standard conditions. For example, 65° F. return gas and 0° F. sub-cool, or some other standard at testing. To the extent the specified design conditions differ from standard, conversions are performed to reflect the condition changes. The conversions alter the standard conditions to the new design conditions such as, for example, 25° F. superheat and 10° F. sub-cool. The conversions are derived from thermodynamic principles such as, $Q=m\Delta h$, where Q=Capacity, m=mass flow, and $\Delta h$=enthalpy change. The query returns a list, after which the user may select a compressor and continue with the performance calculation process.

Returning to FIG. 2, the exemplary compilation routes merge at step 80 for parameter modification as illustrated by the main selection interface 300 shown in FIG. 4. At step 80, via the main selection interface 300, the user can modify at data entry points 82, 84, and 86, the evaporating temperature, condensing temperature and the voltage, respectively. In addition, referring to FIG. 4, the user can either choose the default settings for return gas and super-heat by selecting toggle point 81, or hold one of the temperatures constant by selecting either toggle point 83 for constant return gas or toggle point 85 for constant super-heat. Selecting either toggle point 83 or 85 disables the unselected toggle point so they are prevented from being selected together. If the default setting point 81 is selected, data entry points 87, 88 and 89 representing the return gas, sub-cool and compressor super-heat temperature, are fixed and cannot be modified. If constant return gas data entry point 83 is selected at step 80, the user can modify the return gas and sub-cool temperatures via data entry points 87 and 88. Data entry point 85 for compressor super-heat, however, is disabled for this configuration preventing modification. Conversely, if a constant super-heat temperature is selected at data entry point 85, the user may change the values for the sub-cool and super-heat temperatures at data entry points 88 and 89, respectively.

Compressor performance is often expressed in terms of saturated suction and discharge temperatures. For compressors that use glide refrigerants, such as R407C, it is advantageous to determine the appropriate temperatures that define the suction and discharge conditions. There are generally two ways to accomplish this, by midpoint or dew point temperatures. The midpoint approach is expressed by using temperatures that are midpoints of the condensation and evaporation processes. While this is a valid approach for non-glide refrigerants the performance data for compressors using glide refrigerants is more accurate when determined at dew point. The term "glide", as used herein, is widely used in industry to describe how the temperature changes, or glides, from one value to another during the evaporation and condensation processes. Numerous refrigerants possess a gliding effect. In some, the glide is relatively small and normally neglected, but in others, such as the R407 series, the glide is measurable and can have an effect on a refrigeration cycle and compressor performance data.

At step 125 in FIG. 2, performance calculator 30 determines whether the compressor selected uses a glide refrigerant. If so, a conversion option 127 for converting the glide refrigerant midpoint temperature to a dew point temperature appears on main selection interface 300 as shown in FIG. 4.

Once all data is inputted, an operating envelope check is performed at step 130 on the data to verify that it is within compressor operating limits. Each compressor has design and application limits that are predetermined and are defined by evaporating and condensing temperature limits. Each application has an operating envelope, and the check verifies that the compressor selected can run within its operating envelope. The code used for the verification of compressor operating limits performed at step 130 is shown in the Appendix. The operating envelope will be described in detail below.

After final parameter selections are made, the user orders performance calculator 30 to calculate the Capacity, Power, Current, Mass Flow, EER and Isentropic Efficiency for the compressor selected 140. The user can also select from the main selection interface 300 another compressor using the model number method, or by the application condition method previously discussed. Additional features include creating data tables representing a compressor's operating envelope, graphically showing the operating envelope and checking the rated amperage for the compressor selected.

Figure 6:
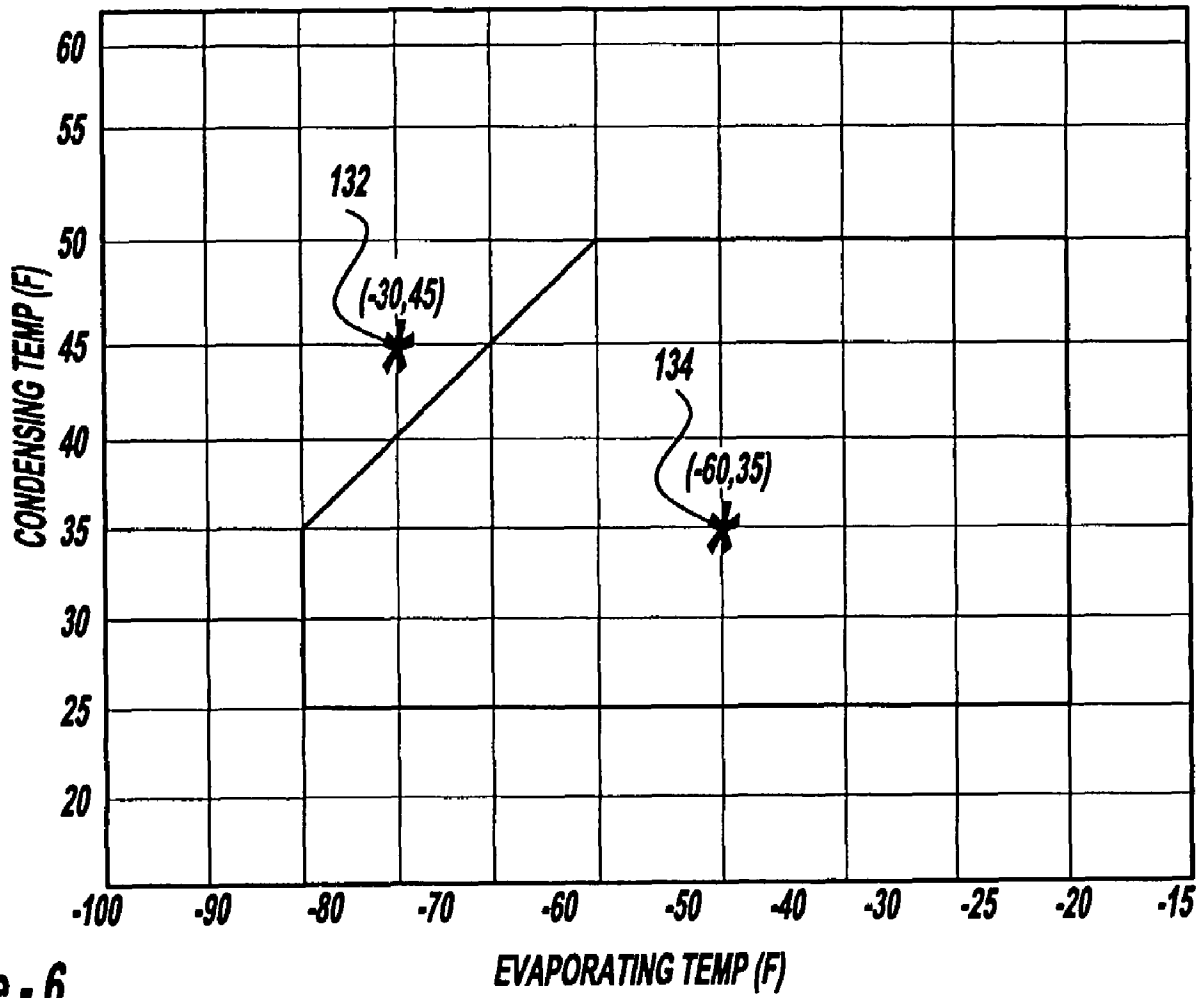
FIG. 6 is a graphical representation of an operating envelope according to the present invention.

As briefly explained earlier, each application has an operating envelope. The purpose of the envelope is to define an area that encompasses the operating range for each compressor. An example of an operating envelope is graphically represented in FIG. 6. The envelope is defined by a series of points that represent the lower and upper limits of the evaporating and condensing temperatures for a given compressor. If an evaporating or condensing temperature is selected that is outside the operating envelope, such as at point 132, which represents an evaporation temperature of −30° F. and a condensing temperature of 45° F., a message appears in a display window 110 (shown in FIG. 4). The message informs the user that the conditions are outside the operating envelope, in which case no performance calculations are returned. An example of a set of temperatures that falls within the operating envelope, and returns performance results, is located at point 134, where the evaporating temperature is −60° F. and the condensing temperature is 35° F.

Several additional features of the performance calculator 30 are available at the main selection interface 300 of FIG. 4. One such feature is the create tables function, which is shown in FIG. 7. The function generates a table that displays the following parameters: Capacity (Btu/hr) 140, Power (Watts) 142, Current (Amps) 144, Mass Flow (lbs/hr) 146, EER (Btu/Watt-hr) 148 and Isentropic Efficiency (%) 150 for an entire operating envelope. Referring to cell A in FIG. 7, the above parameters are given for a condensing temperature of 150° F. and an evaporating temperature of 55° F. This table is also a comma separated variable (CSV) document that can be printed or exported to another platform.

Figure 8:
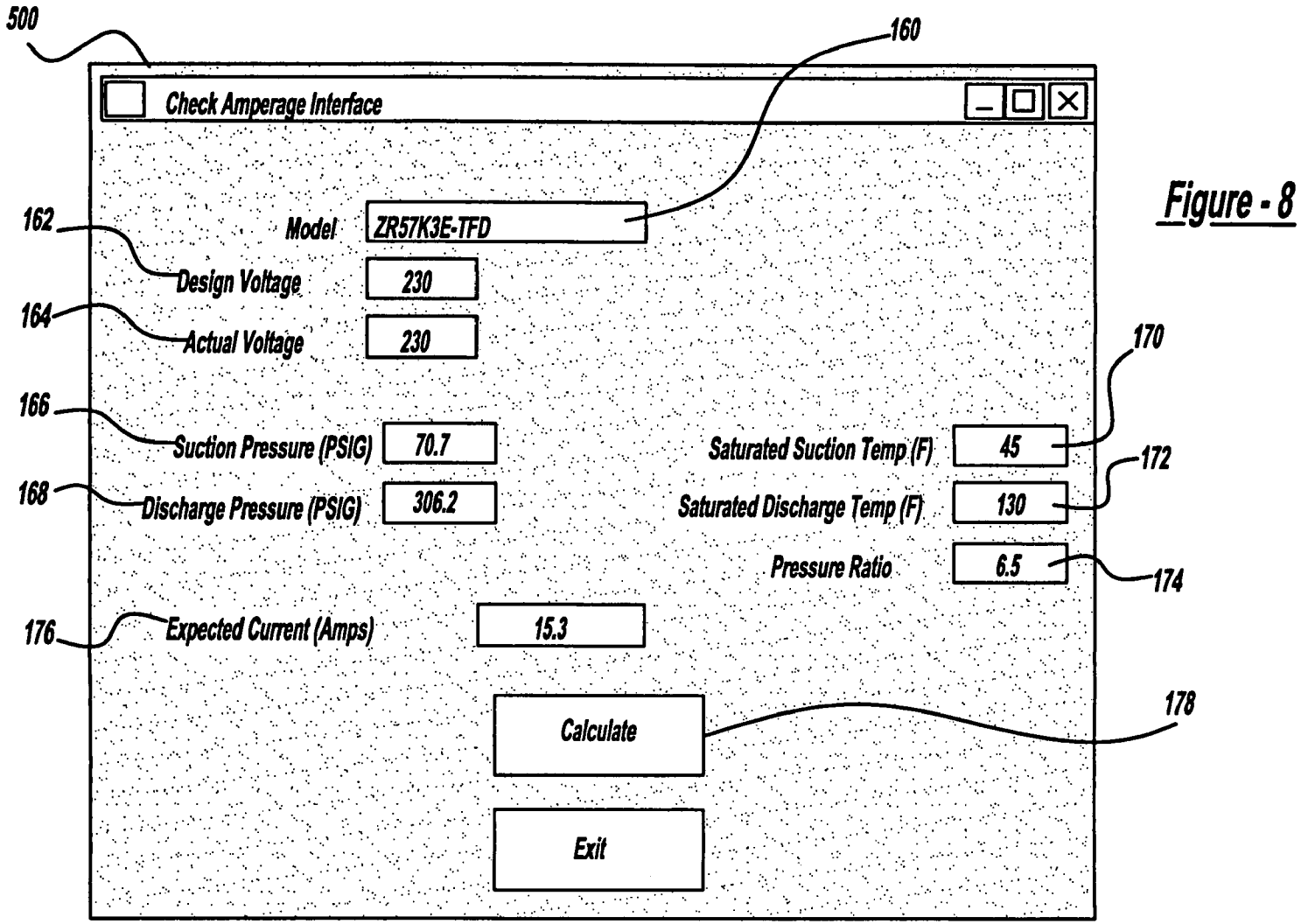
FIG. 8 shows a check amperage interface of the present invention.

Another feature available from main selection interface 300 of FIG. 4 is a check amperage function. A check amperage interface 500, as shown in FIG. 8, displays the model number selected at step 60 for the current application and the design voltage 162 for the selected compressor. At data points 164, 166 and 168 the user inputs the compressor's measured voltage, suction pressure and discharge pressure, respectively. Upon activating the calculate button 178 performance calculator 30 returns the expected saturated suction temperature, saturated discharge temperature, pressure ratio and current in amps at display points 170, 172, 174, and 176, respectively.

The description of the invention is merely exemplary in nature and, thus, variations that do not depart from the gist of the invention are intended to be within the scope of the invention. Such variations are not to be regarded as a departure from the spirit and scope of the invention.

APPENDIX

This function does envelope checking to determine if a given set of evaporating and condensing points fall inside or outside of the operating envelope. The results returned are 0 if within and 1 if outside.

Function outsideEnv(ByVal UseTemplate As String, ByVal Te As Single, ByVal Tc As Single, Optional ByVal EnvRestrictFlag As Single) As Single

```
If EnvRestrictFlag = 1 Then
  EnvTe = RestrictEnvTe( )
  EnvTc = RestrictEnvTc( )
  EnvType = RestrictEnvType( )
  n = Restrict_n
  Te = Te + 0.000001
  Tc = Tc + 0.000001
Else
  EnvTe = NormEnvTe( )
  EnvTc = NormEnvTc( )
  EnvType = NormEnvType( )
  n = Norm_n
```

-continued

```
End If
TeMin = EnvTe(1)
TeMax = EnvTe(1)
TcMin = EnvTc(1)
TcMax = EnvTc(1)
For i = 2 To n
  If EnvTe(i) < TeMin Then
    TeMin = EnvTe(i)
    TeMini = i
  End If
  If EnvTe(i) > TeMax Then
    TeMax = EnvTe(i)
    TeMaxi = i
  End If
  If EnvTc(i) < TcMin Then
    TcMin = EnvTc(i)
    TcMini = i
  End If
  If EnvTc(i) > TcMax Then
    TcMax = EnvTc(i)
    TcMaxi = i
  End If
Next i
If Te < TeMin Or Te > TeMax Or Tc < TcMin Or Tc > TcMax Then
  outsideEnv = 1
  Exit Function
End If
For i = 1 To n
If Te >= EnvTe(i) And EnvType(i) = 0 And EnvTe(i) <> TeMax Then
  Env1L = EnvTe(i)
  Env1Li = i
  done1L = 1
End If
If Te < EnvTe(i) And EnvType(i) = 0 And done2L <> 1 Then
  Env2L = EnvTe(i)
  Env2Li = i
  done2L = 1
End If
If done2L <> 1 Then
  Env2L = TeMax
  Env2Li = TeMaxi
End If
If Te >= EnvTe(i) And EnvType(i) = 1 And EnvTe(i) <> TeMax Then
  Env1U = EnvTe(i)
  Env1Ui = i
  done1U = 1
End If
If Te < EnvTe(i) And EnvType(i) = 1 And done2U <> 1 Then
  Env2U = EnvTe(i)
  Env2Ui = i
  done2U = 1
End If
If done2L <> 1 Then
  Env2U = TeMax
  Env2Ui = i
End If
Next i
If EnvTc(Env1Li) <> EnvTc(Env2Li) Then
  y = yfromeq(Te, EnvTc(Env1Li), EnvTc(Env2Li), EnvTe(Env1Li),
EnvTe(Env2Li))
    If Tc < y Then
      outsideEnv = 1
      Exit Function
    End If
End If
If EnvTc(Env1Ui) <> EnvTc(Env2Ui) Then
  y = yfromeq(Te, EnvTc(Env1Ui), EnvTc(Env2Ui), EnvTe(Env1Ui),
EnvTe(Env2Ui))
    If Tc > y Then
      outsideEnv = 1
      Exit Function
    End If
End If
If EnvTc(Env1Ui) = EnvTc(Env2Ui) Then
  If Tc > EnvTc(Env1Ui) Then
    outsideEnv = 1
    Exit Function
  End If
End If
```

-continued

```
End Function
Function yfromeq(ByVal x As Single, ByVal y1 As Single, ByVal y2
As Single, ByVal x1 As Single, ByVal x2 As Single) As Single
  yfromeq = (y2 - y1) / (x2 - x1) * (x - x1) + y1
End Function
```

What is claimed is:

1. A method comprising:

accessing compressor operating data;

determining application conditions;

selecting a compressor;

defining an operating envelope for said selected compressor, said operating envelope including operating limits of said selected compressor;

comparing compressor operating data for said selected compressor to said application conditions to determine whether said selected compressor operates within said operating envelope;

generating an output based on whether said selected compressor operates within said operating envelope.

2. The method according to claim 1, wherein said selecting said compressor includes selecting said compressor based on design conditions.

3. The method according to claim 2, wherein said determining application conditions includes inputting an application condition from a group comprising: evaporating temperature, condensing temperature, constant return gas temperature, constant compressor super-heat temperature, capacity rate, capacity tolerance percentage, frequency, phase, refrigerant, product type, compressor frequency and application type.

4. The method according to claim 1, wherein said selecting said compressor includes selecting said compressor by category.

5. The method according to claim 4, wherein said category is selected from a group comprising: OEM production, service replacement, and internationally available models.

6. The method according to claim 1, wherein said selecting said compressor includes selecting said compressor by model number.

7. The method according to claim 1, wherein said comparing said compressor operating data for said selected compressor includes querying a database.

8. The method according to claim 1, wherein said comparing said compressor operating data for said selected compressor includes converting standard conditions to said application conditions.

9. The method according to claim 1, further comprising determining suction and discharge conditions.

10. The method according to claim 9, wherein said determining said suction and discharge conditions includes determining a temperature that is a midpoint of condensation and evaporation temperatures.

11. The method according to claim 9, wherein said determining said suction and discharge conditions includes determining a dew point temperature.

12. The method according to claim 1, wherein said defining said operating envelope includes defining a series of points representing said operating limits of said selected compressor, including lower and upper limits of evaporating and condensing temperatures for said selected compressor.

13. The method according to claim 1, further comprising calculating performance data of said selected compressor.

14. The method according to claim 13, wherein said calculating includes calculating operating parameters selected from a group comprising: capacity, power, current, mass flow, energy efficiency ratio (EER) and isentropic efficiency.

15. The method according to claim 13, further comprising generating a table illustrating said calculated performance.

16. The method according to claim 1, wherein said generating said output includes displaying said output based on whether said selected compressor operates within said operating envelope.

17. The method according to claim 16, wherein said displaying said output includes displaying a message indicating whether said selected compressor operates within said operating envelope.

18. A system for calculating the performance of a compressor, the system comprising:

a controller associated with a cooling system and in operable communication therewith;

a database including compressor specification data;

a computer in communication with said controller and operable to access said database; and a user interface associated with said computer and operable to select a compressor from said database, input application conditions, compare data for said selected compressor to said inputted application conditions, and verify operating limits of said selected compressor based on said compressor specification data and said input application conditions.

19. The system according to claim 18, wherein said input application conditions are selected from a group comprising: evaporating temperature, condensing temperature, constant return gas temperature, constant super-heat temperature, capacity rate, capacity tolerance percentage, frequency, phase, refrigerant, product type and application type.

20. The system according to claim 18, wherein said computer is operable to query said database to compare data for said selected compressor to said inputted application conditions.

21. The system according to claim 18, wherein said computer is operable to convert standard conditions to said inputted application conditions to compare data for said selected compressor to said inputted application conditions.

22. The system according to claim 18, wherein said computer is operable to define an operating envelope to verify operating limits of said selected compressor.

23. The system according to claim 22, wherein said operating envelope includes a series of points representing lower and upper limits of evaporating and condensing temperatures for said selected compressor.

24. A method comprising:

accessing compressor operating data;

determining application conditions;

selecting a compressor;

defining an operating envelope for said selected compressor, said operating envelope including operating limits of said selected compressor;

comparing compressor operating data for said selected compressor to said application conditions to determine whether said selected compressor operates within said operating envelope;

calculating performance data of said selected compressor;

generating an output based on said calculated performance data.

25. The method according to claim 24, wherein said selecting said compressor includes selecting said compressor based on design conditions.

26. The method according to claim 24, wherein said determining application conditions includes inputting an application condition from a group comprising: evaporating temperature, condensing temperature, constant return gas temperature, constant compressor super-heat temperature, capacity rate, capacity tolerance percentage, frequency, phase, refrigerant, product type, compressor frequency and application type.

27. The method according to claim 24, wherein said selecting said compressor includes selecting said compressor by category.

28. The method according to claim 27, wherein said category is selected from a group comprising: OEM production, service replacement, and internationally available models.

29. The method according to claim 24, wherein said selecting said compressor includes selecting said compressor by model number.

30. The method according to claim 24, wherein said comparing said compressor operating data for said selected compressor includes querying a database.

31. The method according to claim 24, wherein said comparing said compressor operating data includes converting standard conditions to said application conditions.

32. The method according to claim 24, further comprising determining suction and discharge conditions.

33. The method according to claim 32, wherein said determining said suction and discharge conditions includes determining a temperature that is a midpoint of condensation and evaporation temperatures.

34. The method according to claim 32, wherein said determining said suction and discharge conditions includes determining a dew point temperature.

35. The method according to claim 24, wherein said defining said operating envelope includes defining a series of points representing said operating limits of said selected compressor, including lower and upper limits of evaporating and condensing temperatures for said selected compressor.

36. The method according to claim 24, wherein said calculating includes calculating operating parameters selected from a group comprising: capacity, power, current, mass flow, energy efficiency ratio (EER) and isentropic efficiency.

37. The method according to claim 24, wherein said generating said output includes generating a table illustrating said calculated performance.

* * * * *